US007444685B2

(12) United States Patent
Rose

(10) Patent No.: US 7,444,685 B2
(45) Date of Patent: Nov. 4, 2008

(54) RECONFIGURABLE MEALTIME ACCESSORY TOTE FOR ORGANIZING AND TRANSPORTING MEALTIME ACCESSORIES TO REMOTE MEAL LOCATIONS, AND PROTECTING THE CLOTHING OF YOUNG CHILDREN DURING MEALTIME WHEN USING THE SAME

(75) Inventor: Laura Haddad Rose, Waterbury, CT (US)

(73) Assignee: Bonobos, LLC, Waterbury, CT (US)

( * ) Notice: Subject to any disclaimer, the term of this patent is extended or adjusted under 35 U.S.C. 154(b) by 75 days.

(21) Appl. No.: 11/233,433

(22) Filed: Sep. 22, 2005

(65) Prior Publication Data

US 2007/0061939 A1 Mar. 22, 2007

(51) Int. Cl.
*A41B 13/10* (2006.01)

(52) U.S. Cl. ..... 2/49.2; 2/49.1

(58) Field of Classification Search ..... 2/48, 2/49.1–49.5, 51, 52, 46, 50, 102, 88, 85, 2/247, 92, 94, 207; 224/257, 258, 576–578, 224/586, 581; D2/860–864; 206/541, 542, 206/548, 549

See application file for complete search history.

(56) References Cited

U.S. PATENT DOCUMENTS 1,135,833 A * 4/1915 Morse ..... 2/48
1,979,879 A * 11/1934 Harris ..... 2/48
2,364,258 A * 12/1944 Wallace ..... 2/92
3,115,639 A * 12/1963 Moszczynski ..... 2/48
3,979,776 A 9/1976 Gruenwald ..... 2/49 R
4,068,313 A 1/1978 Goldman
4,114,199 A 9/1978 Malan
4,233,688 A 11/1980 Hjerl
4,441,212 A 4/1984 Ahr et al.
4,445,231 A 5/1984 Noel
4,566,130 A 1/1986 Coates
4,601,065 A 7/1986 Sigl
D288,260 S 2/1987 Anderson et al.
4,646,365 A 3/1987 Surprise et al.
4,797,952 A 1/1989 Petrini
4,811,428 A 3/1989 Waldman et al.
4,860,381 A 8/1989 Bartley
4,862,518 A 9/1989 Williams et al.
D305,377 S 1/1990 Labatto et al.
4,946,094 A * 8/1990 Stang ..... 224/270
5,031,241 A 7/1991 Wiedemann (Continued)

*Primary Examiner*—Amy B Vanatta
(74) *Attorney, Agent, or Firm*—Thomas J. Perkowski, Esq., P.C.

(57) ABSTRACT

A reconfigurable mealtime accessory tote, comprising a thin, pliant bib-shaped structure that has a first pocket on the bib-shaped structure with a side opening to receive mealtime utensils (e.g. fork and spoon) in a horizontal direction, and a second pocket with a top opening to receive a drinking cup in the horizontal opening. When arranged in the transport configuration, the bib-shaped structure is adapted to wrap around the drinking cup and utensils and form a rolled up 3-D volumetric structure that can be releasably fastened together (e.g. by button snaps, Velcro or the like) as a single, compact assembly and transported to a location remote from home. When arranged in the mealtime configuration, the bib-shaped structure can function as a bib for the child while eating, using the drinking cup and utensils that were once contained within the reconfigurable mealtime accessory tote during its prior transport configuration.

7 Claims, 14 Drawing Sheets

U.S. PATENT DOCUMENTS 5,075,897 A 12/1991 Daniels
5,184,796 A 2/1993 Maher
5,244,278 A 9/1993 Robitaille
5,312,282 A 5/1994 Cooper
D347,694 S 6/1994 Forgas
D350,220 S 9/1994 Lindy
5,432,952 A 7/1995 Tate
5,483,701 A 1/1996 Ferreyros
5,504,941 A 4/1996 Sell
5,509,141 A 4/1996 Saltzman
5,649,654 A 7/1997 Hayward, Jr.
5,701,605 A 12/1997 Bowen
5,765,225 A 6/1998 Goeckeritz et al.
5,820,084 A 10/1998 Trumbauer et al.
D403,489 S 1/1999 Cameron
5,875,490 A * 3/1999 Woodard et al. ..... 2/49.1
5,881,382 A 3/1999 Bernard et al.
5,898,940 A 5/1999 Cameron
5,911,311 A 6/1999 Hutchins
5,918,311 A 7/1999 Lampson et al.
5,941,437 A * 8/1999 Okumura ..... 224/585
5,960,471 A * 10/1999 Burton ..... 2/48
6,000,056 A 12/1999 Brady et al.
6,000,664 A 12/1999 Hood
D420,204 S 2/2000 Sasani
6,055,667 A 5/2000 Jimenez
6,070,268 A 6/2000 Holland
6,105,165 A 8/2000 Johnson et al.
6,122,771 A 9/2000 Cook et al.
6,128,780 A 10/2000 Reinhart et al.
6,213,304 B1 4/2001 Juliussen
6,216,269 B1 4/2001 Smith et al.
6,256,788 B1 7/2001 Loewer et al.
6,266,820 B1 7/2001 Gupta et al.
D446,384 S 8/2001 Cruz
D448,143 S 9/2001 Shealey
6,282,716 B1 9/2001 Patterson et al.
6,345,392 B1 2/2002 Rios
6,363,530 B1 4/2002 Lampson et al.
6,381,751 B1 5/2002 Benjamin et al.
6,442,759 B1 9/2002 Straham, Jr. et al.
6,499,140 B1 12/2002 Benjamin et al.
D473,364 S 4/2003 Conte
6,581,210 B2 6/2003 Kaloustian
6,715,226 B1 4/2004 Sikanovski
D492,091 S 6/2004 Nakama-Mitsunaga
6,742,189 B2 6/2004 Bennett
6,745,399 B1 6/2004 Austin
6,789,265 B1 9/2004 Vonrinteln
6,799,330 B1 10/2004 Lansdell
6,826,780 B1 12/2004 Romesburg
6,839,907 B2 * 1/2005 Katz ..... 2/48
7,178,170 B2 * 2/2007 Thompson ..... 2/48
2004/0098781 A1 * 5/2004 Sky ..... 2/49.2
2004/0205876 A1 * 10/2004 Bruffett ..... 2/49.2
2005/0028239 A1 * 2/2005 Rees ..... 2/49.1
2006/0174390 A1 * 8/2006 Wakhloo et al. ..... 2/48
2007/0028342 A1 * 2/2007 Chan ..... 2/48

* cited by examiner

RECONFIGURABLE MEALTIME ACCESSORY TOTE FOR ORGANIZING AND TRANSPORTING MEALTIME ACCESSORIES TO REMOTE MEAL LOCATIONS, AND PROTECTING THE CLOTHING OF YOUNG CHILDREN DURING MEALTIME WHEN USING THE SAME

BACKGROUND OF INVENTION

1. Field of Invention

The present invention relates to apparatus for organizing and transporting mealtime accessories to locations remote from home, and protecting the clothing of small or young children during meals.

2. Brief Description of the State of Knowledge in the Art

For centuries, baby bibs have been used to protect the clothing of infants and young children alike from spilled foods and liquids while drinking and eating. However, in more recent years, the basic bib structure has been modify in various ways to provide additional benefits to the child and/or caregiver. A brief summary of some of these improvements is believed to be in order, taken in a reverse historical order.

U.S. Pat. No. 6,000,056 to Brady et al. discloses a disposable bib which includes a panel adapted to overlie a chest region of a wearer having a first surface designed to face outwardly from the wearer, a second surface designed to face toward the wearer, and a compartment(s) formed on or within the second surface of the panel for containing at least one of an eating utensil and a towelette therein.

U.S. Pat. No. 5,509,141 to Saltzman discloses an insulated bib apparatus with a transverse insulated pocket that extends across the bottom of the fully insulated bib having an open top for allowing articles to be placed in it. A closure is provided for securing the top end of the bib in the rolled position so that an article contained in the pocket can be insulated with the foam panels and allows it to form a cylinder shape making it compact for storage.

U.S. Pat. No. 6,213,304 to Juliussen discloses an infant care tote bag for holding infant care supplies therein. The infant care tote bag includes a pair of body portions pivotally coupled together. An elongate shoulder strap is provided having a pair of opposite V-shaped ends which are detachably attached to the body portions.

U.S. Pat. No. 5,765,225 to Goeckeritz et al. discloses a baby bib having a bottle holding capability. The bib has an attached bottle-holding structure which maintains a baby bottle in a predetermined position, both laterally and longitudinally. The bottle holding attachment is made of a soft structural material covered with a fabric material similar to the bib fabric. The bottle holder may also be made with a harness attached to it so that it may be held in place without being attached to a bib.

U.S. Pat. No. 5,244,278 to Robitaille discloses an article of manufacture which, except for a zipper, is made from fabric textile and which functions as an all purpose travel accessory item. In one orientation, the article has an extension which can be unrolled from a pouch and used as a bib or lap napkin. The extension has an outer layer that is made of terry cloth and a bottom layer which is made of a nylon fabric. When the extension is unrolled, the pouch will be open and tends to catch any crumbs or liquids that may spill thereon. In another orientation, the pouch may be turned inside-out and can be completely closed without having to roll-up the extension therein.

U.S. Pat. No. 4,566,130 to Coates discloses a diapering station formed of a single piece of material divided by fold lines into three successive sections to cushion an infant on a support surface and store infant accessories for diaper changing. The diapering station is converted into a carrying bag for infant accessories by folding the two end sections inwardly, one over the other along the fold lines, onto the middle section, enabling the bag to be conveniently carried by a combination handle and back pack strap. A waterproof, removable pouch on the middle section of the station provides a clean surface for the infant's bottom and stores dirty diapers for subsequent washing. An inwardly opening pocket formed in one of the end sections of the station stores clean diapers, and storage of infant accessories such as bottles and food jars is provided in additional pockets formed in the other end section of the station. A cylindrical, bib storage pouch adjacent the strap handle in the station provides stiffness to the unit, folded to form the carrying bag. The design of the station positions diapers and accessories within close reach of the attendant during diaper changing.

U.S. Pat. No. 5,483,701 to Ferreyros discloses a bib for fitting about the neck of a baby and having a one piece body and a pocket or pouch secured thereto. Pouch is secured to bib between a pair of spaced neck portions and with the closed end of pouch stitched to bib along an upper edge of bib. The pouch is free and turned outside in when the bib is positioned about the neck of a child. The bib is placed within pouch by folding it or stuffing it via the closed end of the pouch while the pouch is turned inside out. The open end of pouch is then closed with bib therein, and pouch may then be stored or transported.

U.S. Pat. No. 6,000,664 to Hood discloses a baby bottle support bib intended to be worn by an individual while bottle feeding a baby. A baby bottle is removably attached to the bib so as to be held in the preferred orientation for feeding the baby.

U.S. Pat. No. 6,745,399 to Austin discloses an integrated baby bottle holder, bib, and pillow to aid infant caregivers in conveniently and comfortably feeding suckling infants in any number of environments. A bib contains a central pocket for insertion of a soft pillow, and a baby bottle holder attachment portion, for securing a baby bottle holder to the bib. The baby bottle holder is constructed in the general shape of a bottle with an opening on one end, containing an elastic band, for insertion, and retention, of a baby bottle.

U.S. Pat. No. 5,312,282 to Cooper discloses a baby bottle structure forming a musical doll and providing means for carrying a pacifier within its body structure. A bib is provided with the baby bottle doll and supports the baby bottle about the neck of an infant. A rattle or rattles may be removably attachable to the bib and form arms of the doll.

U.S. Pat. No. 6,442,759 to Straham, Jr. et al. discloses a bib which provides a mechanism (i.e., a strap) for securing accessories such as teethers, rattles, pacifiers, toys, etc. to the front of the multi-purpose baby bib, in a reachable location to the child.

U.S. Pat. No. 6,499,140 to Benjamin et al. discloses a disposable bib having an improved pocket that can be maintained in an open configuration for receiving and holding spilled solid and liquid food material. The bib has a body panel, a pocket panel forming a pocket space between the body panel and the pocket panel, and a third panel joined to the pocket panel. The third panel includes a flexible member joined thereto that helps to maintain the pocket space in an open configuration once the third panel is folded into the pocket space.

U.S. Pat. No. 6,128,780 Reinhart et al. also discloses a disposable bib having an improved pocket. The bib has a body panel, a pocket panel, and a third panel disposed between the body panel and the pocket panel. The third panel helps to maintain the pocket in an open configuration. U.S. Pat. Nos. 6,363,530; 6,282,716; 6,266,820; 6,256,788; and 4,811,428 also disclose improvements in disposable bib design, construction and manufacture.

Indeed, while the above prior art Patents address the problems of caregivers needing to transport a child's mealtime utensils to remote locations in a clean condition, protecting their child's clothing while eating using bib structures of various sorts, and returning utilized mealtime utensils back home, the prior art when taken as a whole fails to satisfy such problems in a way that is consistent with the modern lifestyle that most child caregivers on the go must live.

The need for a better quality, more useful bib-type structure, with enhanced functionality and performance beyond it's historical use as a shield against spilled foods or liquids, would translate into a better offering for manufacturers and consumers alike.

OBJECTS AND SUMMARY OF THE INVENTION

Accordingly, it is a primary object of the present invention to provide an improved method of and apparatus for organizing and transporting a child's mealtime accessories to locations remote from home, and protecting the clothing of children during meals when using the same, while avoiding the shortcomings and drawbacks of the prior art apparatus and methodologies heretofore known.

Another object of the present invention is to provide such apparatus in the form of a reconfigurable mealtime accessory tote that has both a transport configuration and a mealtime configuration.

Another object of the present invention is to provide such a reconfigurable mealtime accessory tote, wherein the reconfigurable tote comprises a thin, pliant bib-shaped structure that has a horizontally-disposed pocket on the bib-shaped structure to receive a drinking cup and other mealtime utensils (e.g. fork and spoon), and which when arranged in the transport configuration, is adapted to wrap around the drinking cup and utensils and form a 3-D volumetric structure that can be releasably fastened together (e.g. by button snaps, Velcro or the like) as a single, compact assembly and transported to a location remote from home, and when arranged in the mealtime configuration, can function as a bib supported upon the chest and about the neck of a child and protecting his or her clothing from soiling while the child is eating his or her meal using the drinking cup and utensils that were once contained within the reconfigurable mealtime accessory tote during its prior transport configuration.

Another object of the present invention is to provide such a reconfigurable mealtime accessory tote, wherein a strap/tether is provided as a handle that allows the reconfigurable tote to be carried to locations remote from home, and which also is capable of holding a pacifier, teether or other toy securely in place once the reconfigurable tote has been reconfigured into its mealtime configuration and put to use on a child by the caregiver.

Another object of the present invention is to provide such a reconfigurable mealtime accessory tote which further includes a vertically disposed pocket on the bib-shaped structure for storing meal time equipment such as disposable wipes, a box of crayons, or other toys or articles of amusement and/or entertainment.

Another object of the present invention is to provide such a reconfigurable mealtime accessory tote, wherein the bib-shaped structure is constructed from a dishwasher-safe material so that the bib-shaped structure, the drinking cup and meal utensils can all be placed together in a dishwasher to be cleaned and sanitized prior to the next use.

Another object of the present invention is to provide such a reconfigurable mealtime accessory tote, which has a compact construction that is suitable for carrying within a conventional diaper bag.

Another object of the present invention is to provide a package for compactly containing a plurality of disposable mealtime accessory totes of the present invention.

Another object of the present invention is to provide such a reconfigurable mealtime accessory tote, wherein the drinking cup and utensils, after they have become soiled during use, can be recontained within the horizontally-disposed pocket of the bib-shaped structure and the mealtime accessory tote reconfigured into its transport configuration, so that the tote can be carried within a diaper or accessory bag without the risk of soiling clean clothing or toys stored therein.

These and other objects of the present invention will become apparent hereinafter and in the claims.

BRIEF DESCRIPTION OF THE DRAWINGS

In order to more fully understand the nature and objects of the present invention, reference should be made to the following Detailed Description of the Illustrative Embodiments which should be read in conjunction with the appended figure Drawings, wherein.

DETAILED DESCRIPTION OF ILLUSTRATIVE EMBODIMENTS OF THE PRESENT INVENTION

Referring now to the figures in the accompanying Drawings, the illustrative embodiments of the present invention will now be described in great technical detail below, wherein like parts are indicated by like reference numbers.

Figure 1:
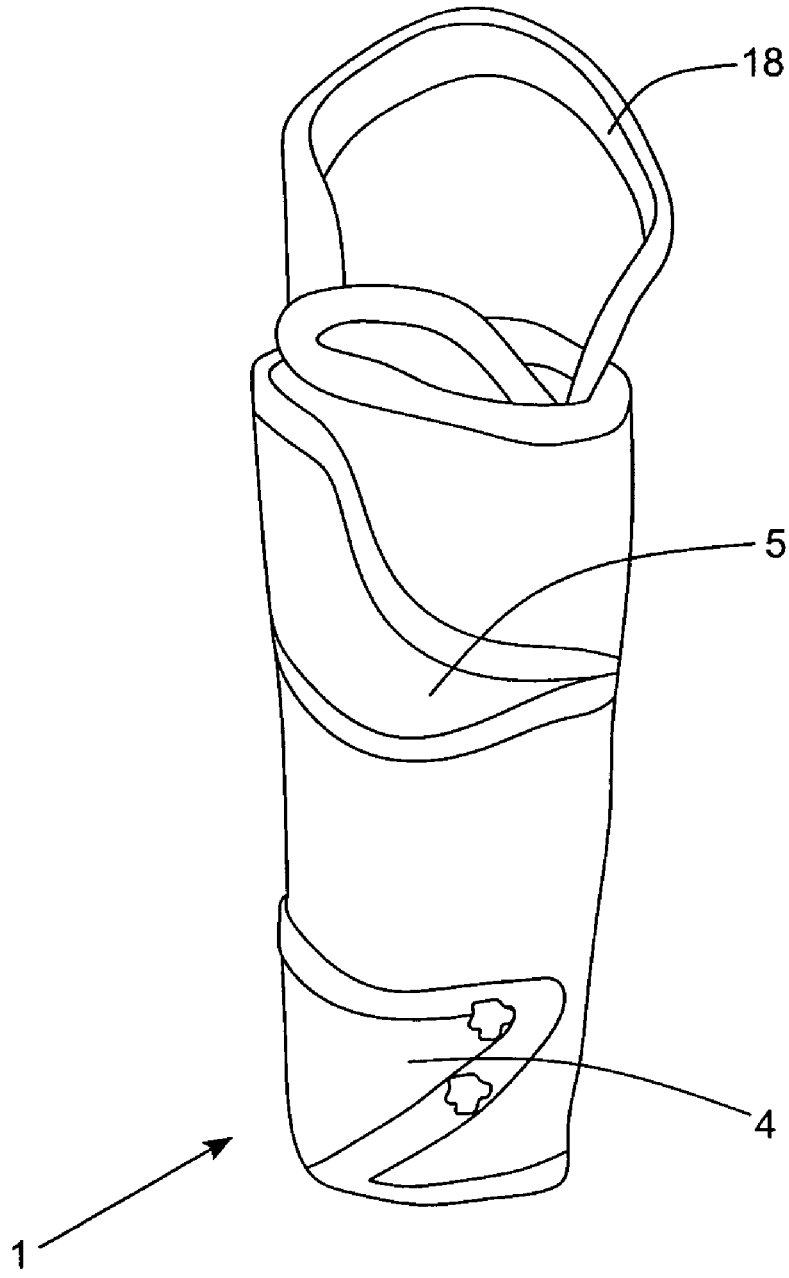
FIG. 1 is a first perspective view of the first illustrative embodiment of the reconfigurable mealtime accessory tote of the present invention, shown as having a substantially cylindrical geometry and arranged in its transport configuration, standing on its end on a floor surface, with its handle ready to be grabbed.
Figure 2:
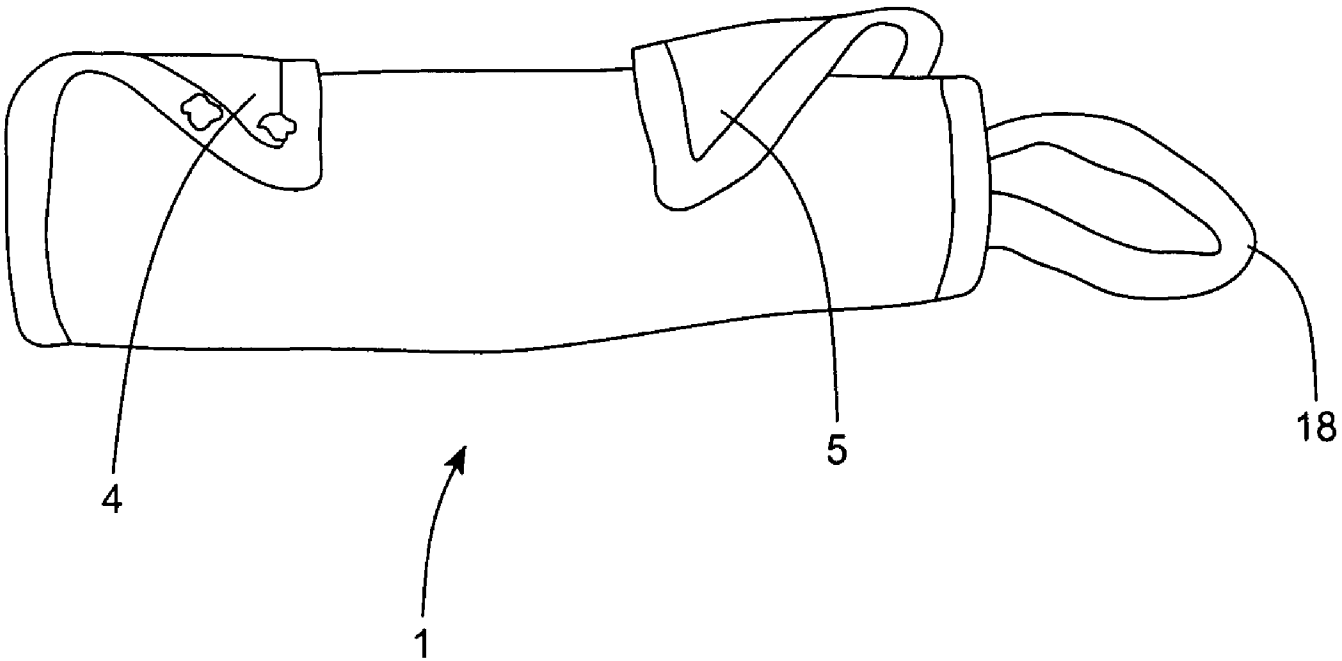
FIG. 2 is a second perspective view of the reconfigurable mealtime accessory tote of FIG. 1, shown arranged in its transport configuration, and resting on its side surface on a floor surface.
Figure 8:
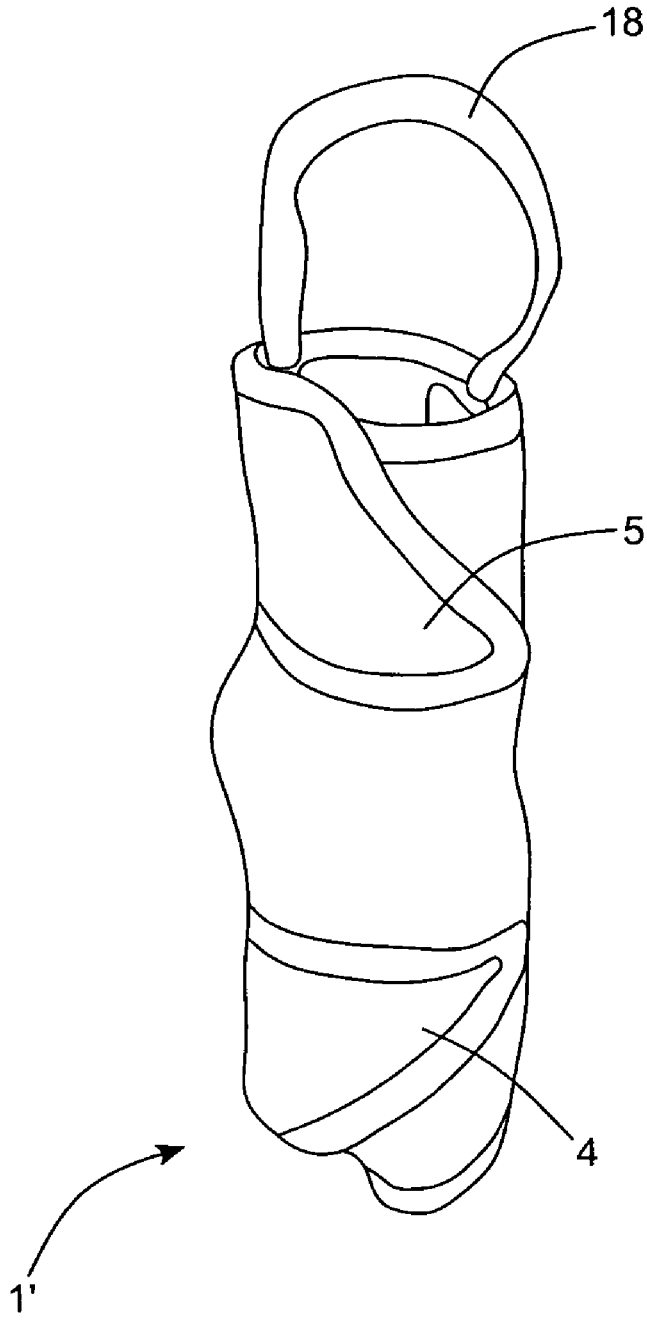
FIG. 8 is a first perspective view of the second illustrative embodiment of the reconfigurable mealtime accessory tote of the present invention, shown as having a substantially rectangular geometry and shown arranged in its transport configuration, standing on its end on a floor surface, with its handle ready to be grabbed.
Figure 9:
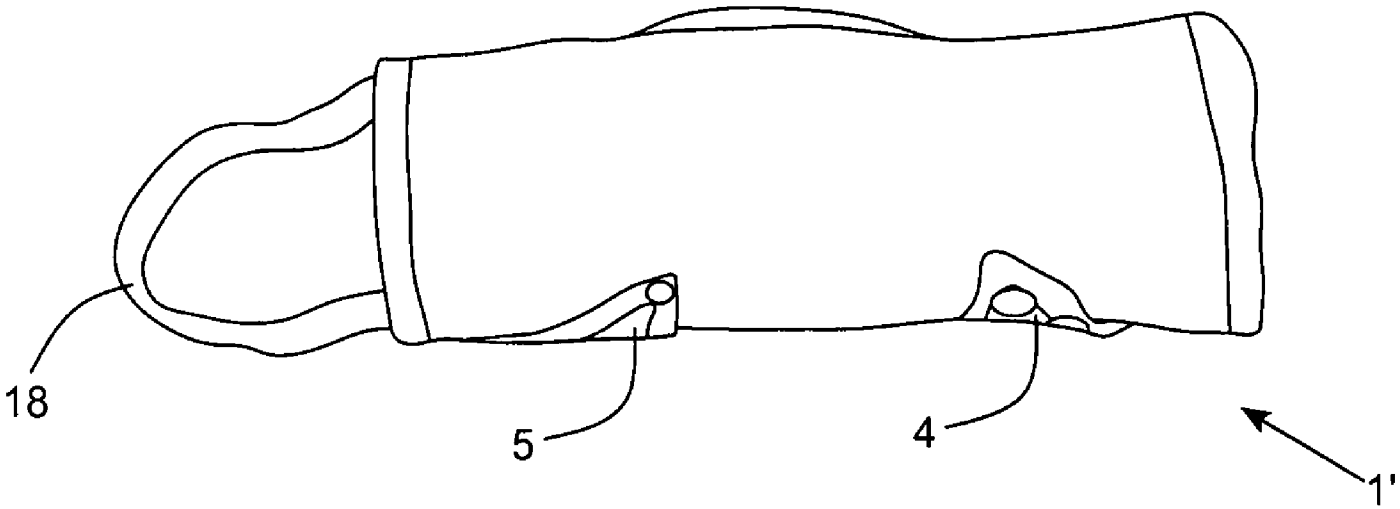
FIG. 9 is a second perspective view of the reconfigurable mealtime accessory tote of FIG. 8, shown arranged in its transport configuration, and resting on its side surface on a floor surface.
Figure 10:
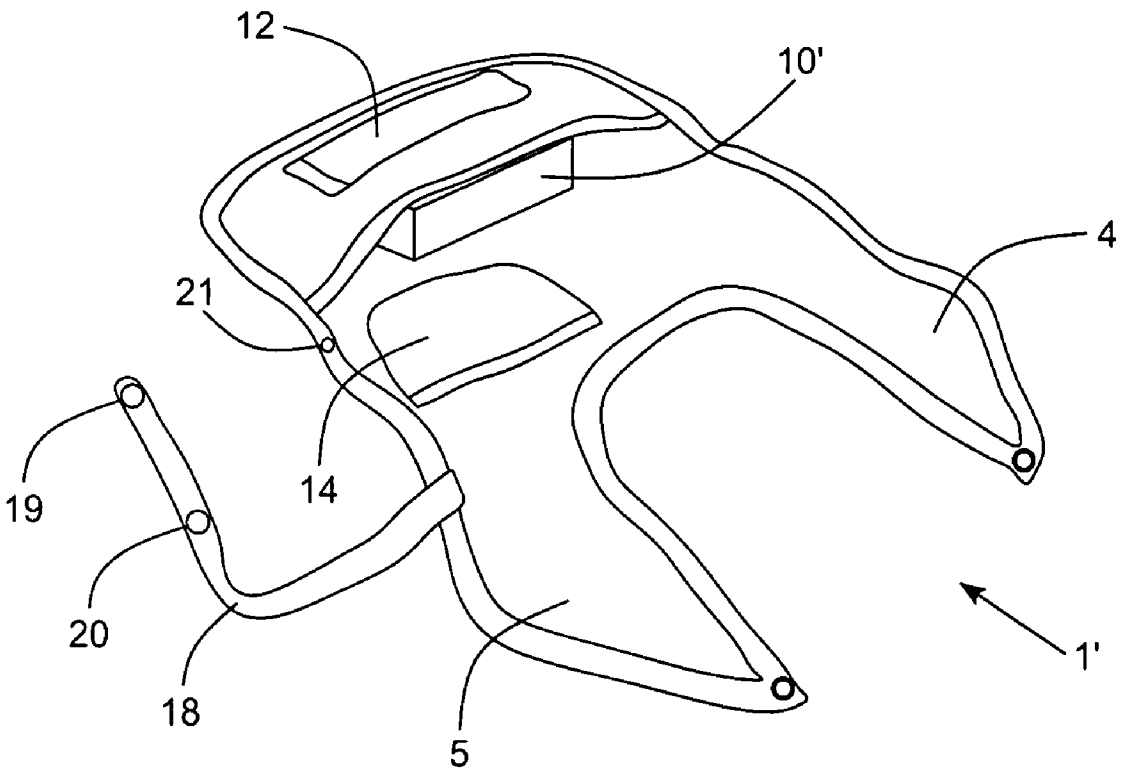
FIG. 10 is a perspective view of the reconfigurable mealtime accessory tote of FIGS. 8 and 9, shown partially disassembled with a drinking cup or juice container of rectangular design placed within the pocket of the pliant bib-shaped structure, and its handle portion disconnected from the edge of the bib-shaped structure.

As shown in FIGS. 1 and 2, the reconfigurable mealtime accessory tote of the first illustrative embodiment of the present invention is shown to have a 3-D volumetric structure having substantially cylindrical geometry. However, this is only one form factor that this article of manufacture and assembly can take on in practice. As shown in FIGS. 8, 9 and 10, the reconfigurable mealtime accessory tote of the present invention, can take on other forms of 3-D volumetric geometry, such substantially rectangular geometry when a drinking cup (or baby bottle) of rectangular design is used as a mealtime accessory. Other geometric form factors, such as oval, triangular etc. can be achieved by using corresponding forms of drinking cups, as will become apparent hereinafter.

In general, the reconfigurable mealtime accessory tote of the present invention has two different configurations: (1) a transport configuration, in which the tote is arranged as a single compact unit, containing a child's mealtime accessories (e.g. drinking cup, spoon and fork, and towelette) ready to be transported to a location remote from home, or wherever the tote has been dispensed to the caregiver (e.g. restaurant); and (2) a mealtime configuration, in which mealtime accessory tote can be reconfigured to function as a bib supported upon the chest and about the neck of a child and protecting his or her clothing from soiling while the child is eating his or her meal using the drinking cup and utensils that were once contained within the reconfigurable mealtime accessory tote during the prior transport configuration.

Figure 4B:
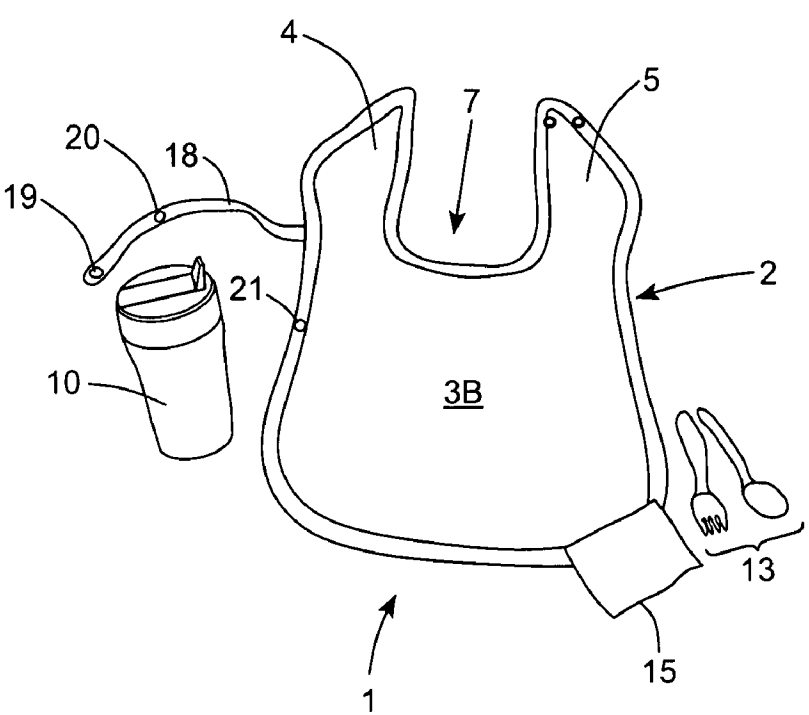
FIG. 4B is a perspective view of the reconfigurable mealtime accessory tote of FIGS. 1 and 2, shown with its pliant bib-shaped structure configured in planar fashion revealing its rear facing surface, with the drinking cup and mealtime utensils removed from its horizontally-disposed pocket, and one end of the handle portion disconnected to the edge of the bib-shaped structure.
Figure 4A:
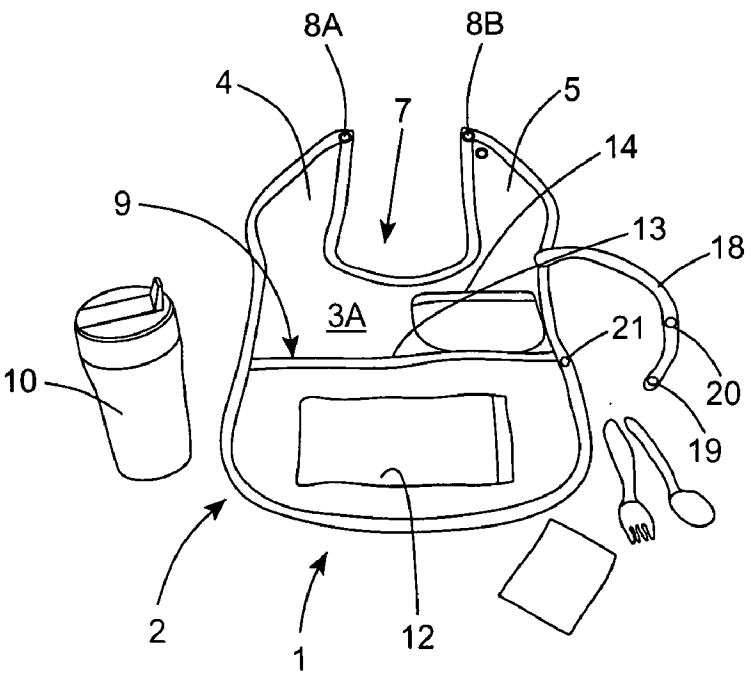
FIG. 4A is a first perspective view of the reconfigurable mealtime accessory tote of FIGS. 1 and 2, shown with its pliant bib-shaped structure configured in planar fashion revealing its front facing surface, with the drinking cup and mealtime utensils removed from its horizontally-disposed pocket, and one end of the handle portion disconnected to the edge of the bib-shaped structure.

As best illustrated in the mealtime configuration shown in FIG. 4A, the mealtime accessory tote 1 comprises: a pliant, lightweight bib-shaped structure 2 having a front panel 3A and a rear panel 3B, and a pair of shoulder extensions 4 and 5, respectively. As shown in FIGS. 4A and 4B, the shoulder extensions extend from the chest-covering portion of the bib-shaped structure, from the proximal ends of shoulder extensions to their distal ends so as to provide a generally-planar neck opening 7 when the bib-shaped structure 2 is supported on a flat, horizontal surface.

As shown in FIGS. 4A and 4B, the bib-shaped structure (1) also comprises a fastening assembly 8 (8A, 8B) for joining together the shoulder extensions 4 and 5 in an overlapping fashion at their distal ends, to thereby enable the bib-shaped structure 2 to be secured around the neckline of a child wearer. The fastening assembly could be realized by a mechanical fastener (e.g. a pair of conventional button snaps) having elements disposed on the shoulder extensions. These elements can penetrate and physically engage a landing surface on the other shoulder extension. Alternatively, the fastening mechanism can include the use of Velcro fasteners, snap-together buttons, a pair of tie strings, or any another other fastening mechanism known in the art.

Figure 5:
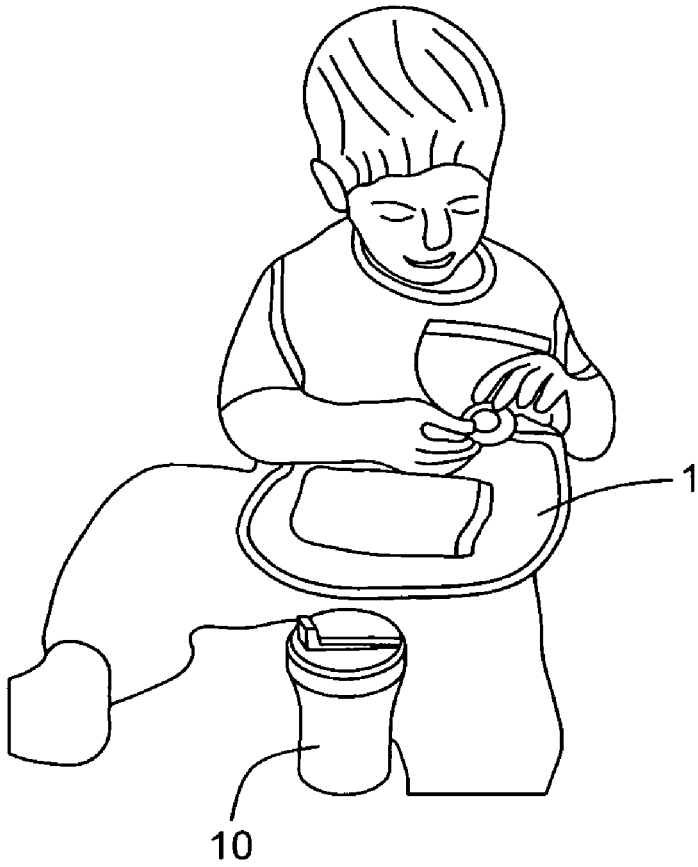
FIG. 5 is a perspective view of the reconfigurable mealtime accessory tote of FIGS. 1 and 2, shown arranged in its mealtime configuration and worn on a child during mealtime.
Figure 6A:
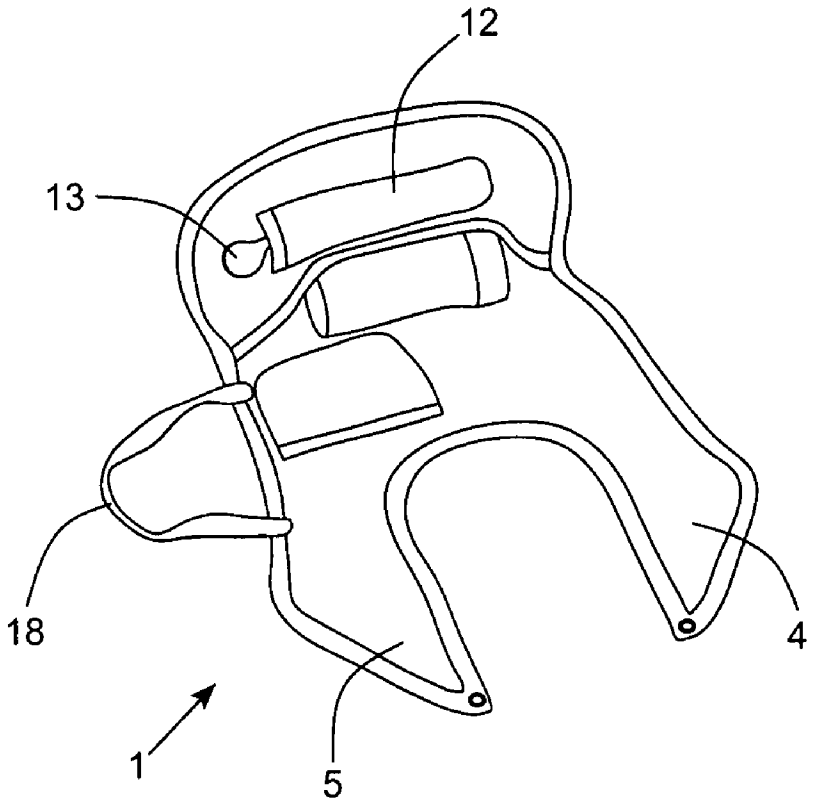
FIG. 6A is a perspective view of the reconfigurable mealtime accessory tote of FIGS. 1 and 2, shown with a soiled drinking cup and utensils placed within the pockets of the pliant bib-shaped structure as the tote being arranged in its transport configuration after completion of a meal.
Figure 6B:
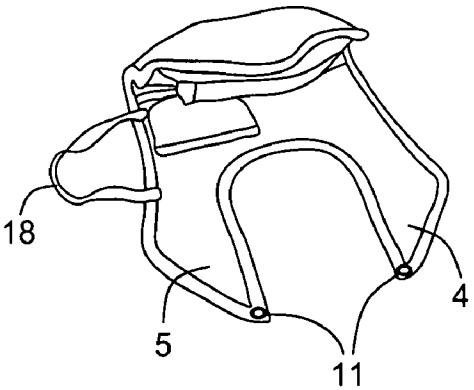
FIG. 6B is a perspective view of the reconfigurable mealtime accessory tote of FIGS. 1 and 2, shown with its pliant bib-shaped structure partially encircling a soiled drinking cup and utensils as the tote is being arranged in its transport configuration after completion of a meal.
Figure 7:
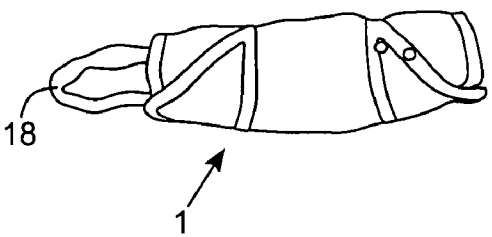
FIG. 7 is a perspective view of the reconfigurable mealtime accessory tote of FIGS. 1 and 2, shown with its pliant bib-shaped structure completely encircling a soiled drinking cup and utensils, after being arranged in its transport configuration after completion of a meal.
Figure 6C:
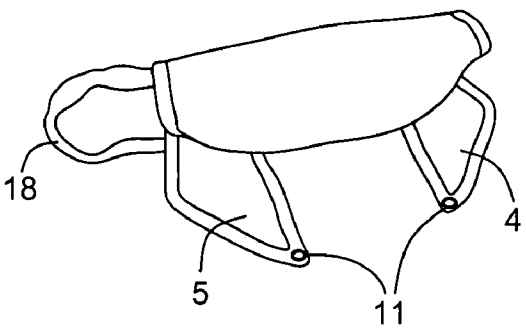
FIG. 6C is a perspective view of the reconfigurable mealtime accessory tote of FIGS. 1 and 2, shown with its pliant bib-shaped structure completely encircling a soiled drinking cup and utensils as the tote is being arranged in its transport configuration after completion of a meal.

As shown in FIGS. 4A and 5 the bib-shaped structure also comprises a horizontally-extending extending pocket panel 9 for catching and receiving food particles (e.g. crumbs etc) when the front panel 3A of the bib-shaped structure is worn facing against the chest of the child wearer. As shown in FIG. 4A, the pocket panel 9 extends laterally across the left and right edges of the bib-shaped structure and is joined to the underlying front panel 3A along the edges by a securing means such as a binding or welt 13. As shown, the pocket panel 9 can have a generally rectangular shape, or alternatively, it can have a generally elliptical shape. In alternative embodiment, illustrated in FIG. 5, the bib-shaped structure 2 can be worn in a manner so that the front panel 3A is facing against the wearer's chest. In this embodiment, the functionality of the food catching pocket 9 would be essentially disabled.

Figure 3A:
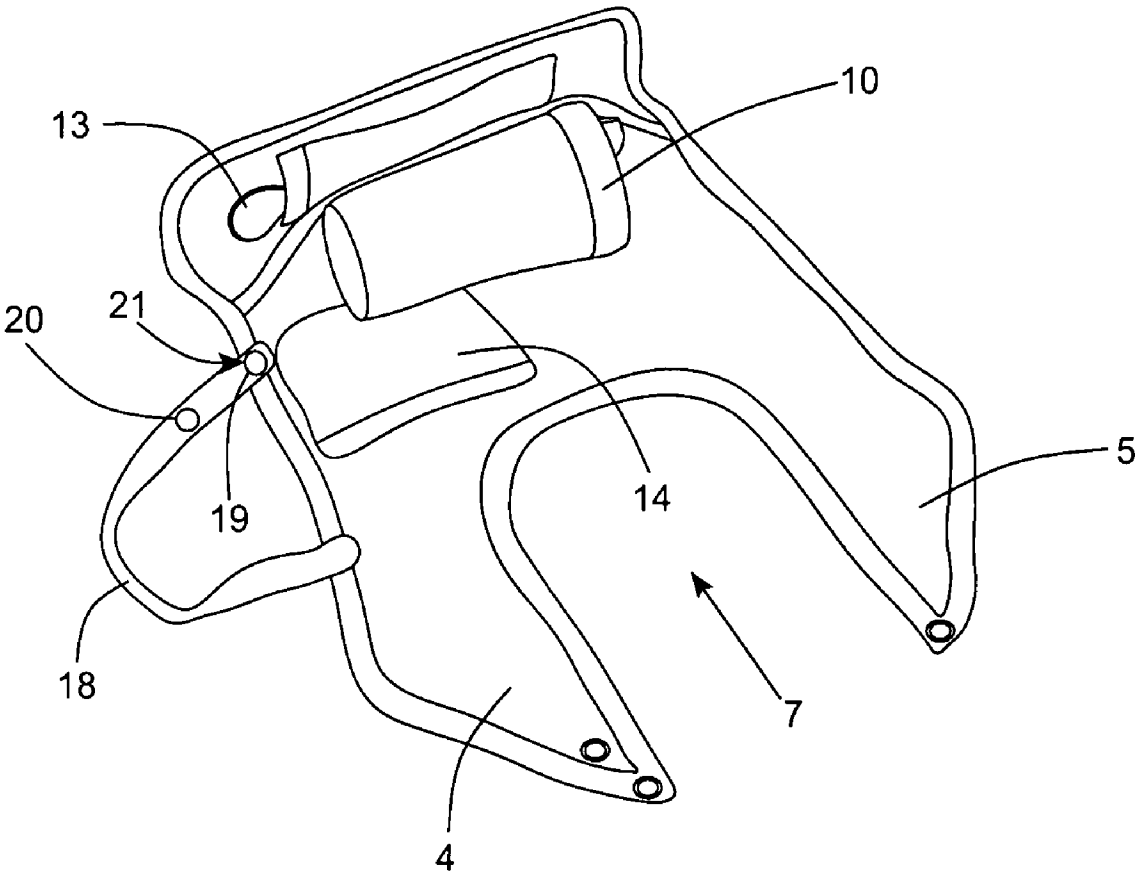
FIG. 3A is a plan view of the reconfigurable mealtime accessory tote of FIGS. 1 and 2, shown with its pliant bib-shaped structure partially encircling a clean drinking cup and utensils, as the tote is being arranged in its transport configuration before a planned meal.
Figure 3B:
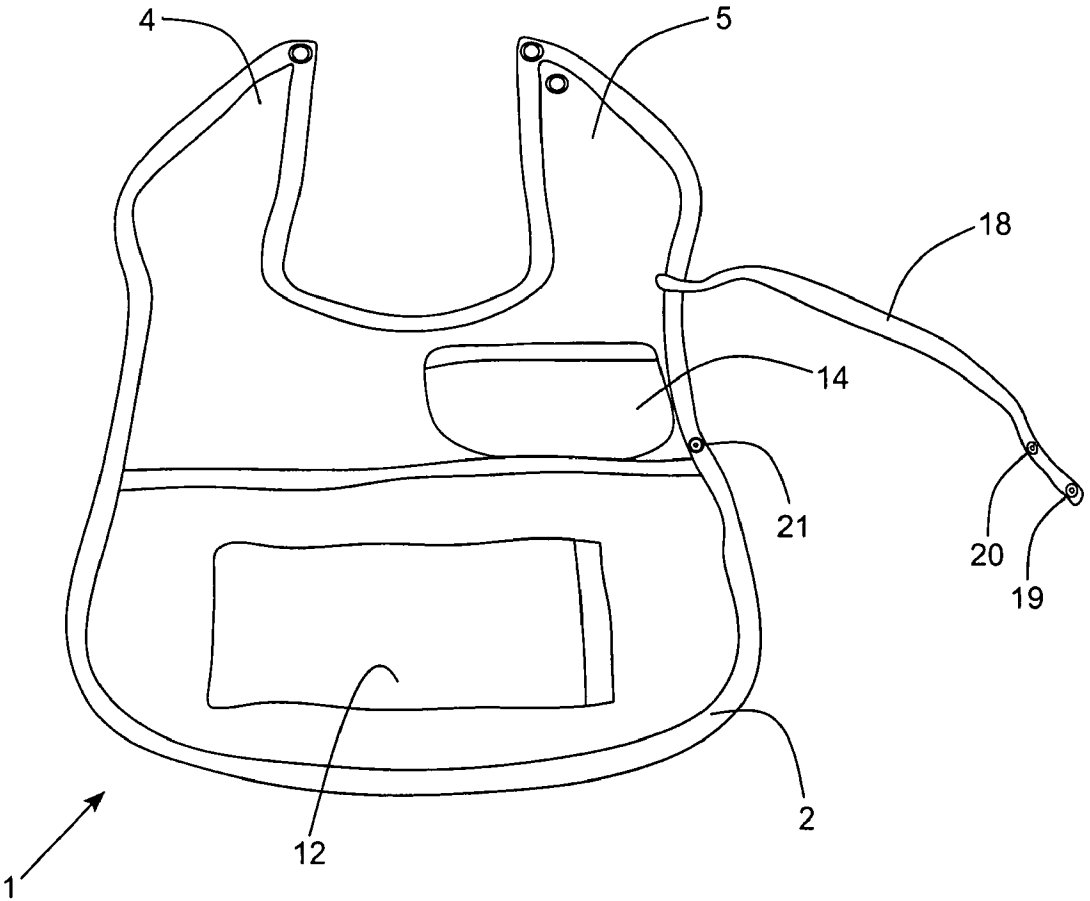
FIG. 3B is a FIG. 3A is a perspective view of the reconfigurable mealtime accessory tote of FIGS. 1 and 2, shown further configured with its pliant bib-shaped structure no longer encircling the drinking cup, with the drinking cup and meal time utensils removed, and one end of the handle portion disconnected from the edge of the bib-shaped structure.

In addition to catching food and crumbs during mealtimes, integrated food catching pocket 9 in the preferred embodiment is also used to store a child's drinking cup (e.g. sippy cup) 10 horizontally therewithin, as shown in FIG. 3A, and which can be securely held in place therewithin by simply fastening the closure 11.

As shown in FIG. 4A, the bib-shaped structure 2 further includes a rectangular horizontal pocket 12 formed upon the larger food catching pocket 9, with an opening provided to allow the storage of a fork and/or spoon 13 when the bib-shaped structure is not in use. Preferably, horizontally-disposed pocket 12 is positioned centrally atop the larger pocket panel 9, and along the central longitudinal axis of the enclosed drinking cup stored therein, so that the mealtime utensils and drinking cup are all aligned and the same horizontal axis, and thereby permit the pliant bib-shaped structure 2 to encircle the drinking cup and utensils (several times), to form a substantially cylindrically shaped tote structure in the transport configuration.

As shown in FIG. 4A, the bib-shaped structure 2 also includes at least a smaller vertically-disposed pocket 14 resting on top of the upper right shoulder extension 5, with an opening on the horizontal axis to allow for the storage of individual anti-bacterial wipes, a small box of Crayons® markers, or other miscellaneous items 15. In alternative embodiments, a second vertically-disposed pocket can also be formed on the upper left shoulder extension 4 to provide for more storage compartments.

As shown in FIG. 3A, the carrying handle/strap 18 is preferably secured to the welt at the upper right shoulder extension 5 by being sewn into the side. The strap 18 also comprises a fastening assembly 19 for joining it together with the lower fastening assembly 21 located on the same side of the bib-shaped structure at a length appropriate to the length of the strap 18. The fastening assembly 19 located at the end of the carrying strap 18 can also be joined together with another fastener 20 on the carrying strap 18, and enable the securing of a toy, teether or pacifier, as best illustrated in FIG. 4A.

When the mealtime accessory tote is arranged its transport configuration, as shown in FIG. 2, the distal portion of the shoulder extensions 4 and 5 is preferably joined to two separated fastening points 8A and 8B located on the rear panel 3B, so that the bib-shaped structure, encircling the drinking cup, and forming a cylindrically-shaped tote, is securely maintained during the transport configuration. Then, during the mealtime configuration, the shoulder extensions 4 and 5 can be detached from the fastening points 8A and 8B, without tearing or otherwise damaging other portions of the bib-shaped structure. Then after being arranged about the neck of the child wearer, shoulder extensions 4 and 5 can be releasably rejoined together in an overlapping fashion by the fastening assembly.

The bib-shaped structure 2 employed in the mealtime accessory tote of the present invention can be fabricated using a composite construction having multiple laminate. The bib-shaped structure 2 can be fabricated using a laminate top sheet of a non-woven or microbial outer layer, an absorbent inner tissue layer, and a garment-facing backsheet layer which is liquid impermeable relative such as vinyl. In a preferred embodiment, the shoulder extensions 4 and 5 and the front panel 3A are formed from a single, continuous sheet of the laminate topsheet, tissue layer, and the backsheet, while the pockets 8, 9, and 12 are formed from a continuous sheet of non-woven or microbial material which is bonded to the outer facing surface on the front panel 3A.

In a second illustrative embodiment, shown in FIGS. 8, 9 and 10, the reconfigurable mealtime accessory tote of the present invention 1' has a substantially rectangular geometry by virtue of the fact that its pliant bib-shaped structure encircles (i.e. wraps) a drinking cup of rectangular design.

Figure 11:
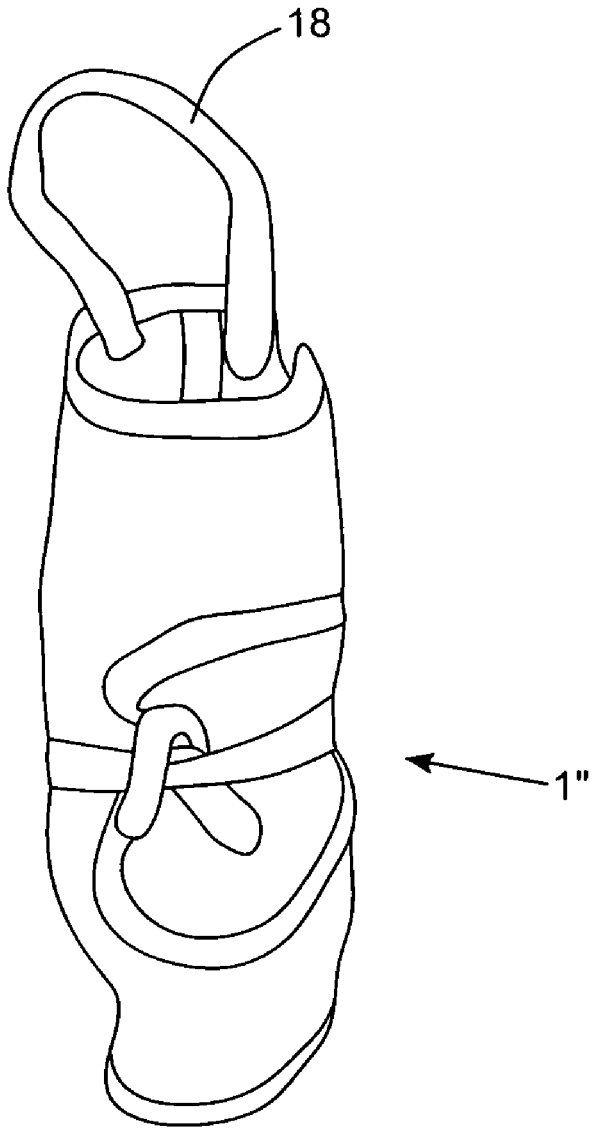
FIG. 11 is a first perspective view of the third illustrative embodiment of the reconfigurable mealtime accessory tote of the present invention, shown as having a substantially cylindrical geometry and arranged in its transport configuration, standing on its end on a floor surface, with its handle ready to be grabbed.
Figure 12:
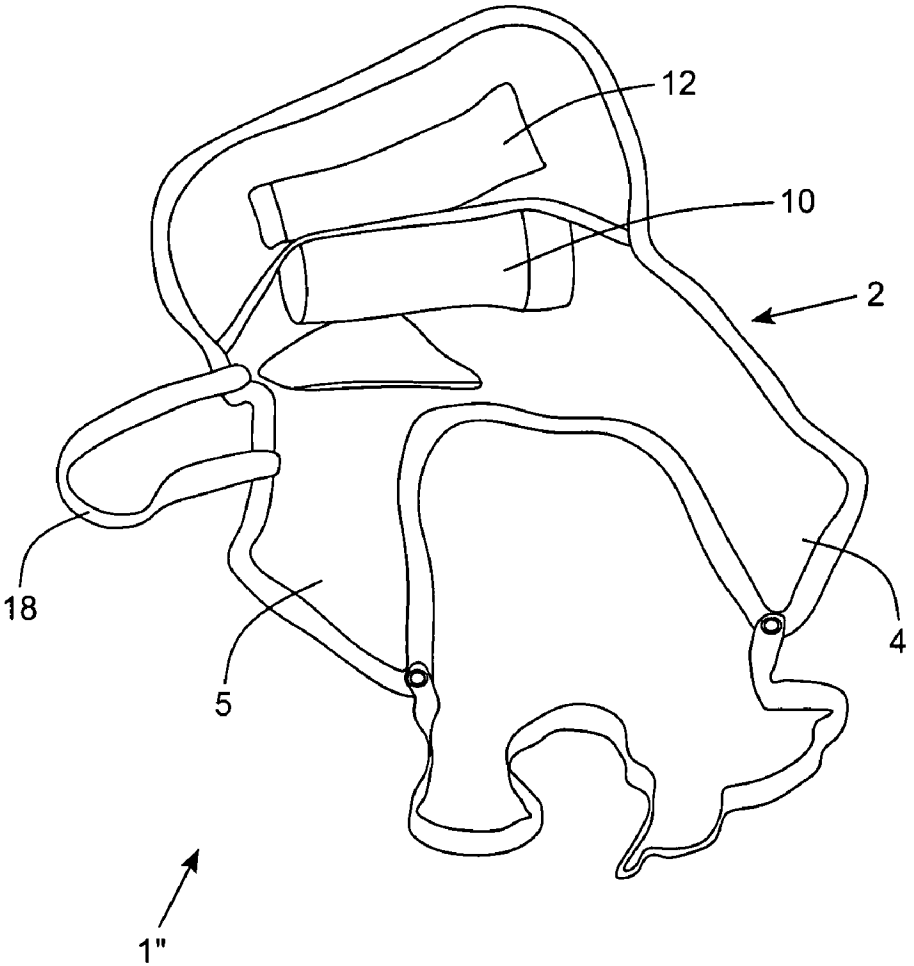
FIG. 12 is a perspective view of the reconfigurable mealtime accessory tote of FIG. 11, shown partially disassembled with its pliant bib-shaped structure encircling a drinking cup stored (along with a fork and spoon) in a horizontally-disposed pocket formed on the front panel surface of the bib-shaped structure, and the pair of tie strings used to fasten the shoulder extensions together (during the mealtime configuration) loose and untied.

In a third illustrative embodiment, shown in FIGS. 11 and 12, the pliant bib-shaped structure 2 encircles a drinking cup or baby bottle that is stored (alone or along with a set of mealtime utensils such as a fork and spoon) in a horizontally-disposed pocket on the outer front panel surface of the bib-shaped structure, while a pair of tie strings and are used to fasten the shoulder extensions together during the mealtime configuration.

In an alternative fourth embodiment, the reconfigurable mealtime accessory tote of the present invention has a 3-D volumetric geometry as shown in FIGS. 1, 2, 8-10 and 11-12, except that the drinking cup (or baby bottle) is stored in the outer horizontally-disposed pocket 12 (or an enlarged version thereof), along with mealtime utensils (e.g. fork and spoon). The advantage of this alternative embodiment is that during the transport configuration, the large open pocket 9 is free for storing packaged snacks that will easily adapt to the thin annulus-shape space formed therein when the mealtime accessory tote is arranged in the transport configuration. Examples of such packaged snacks that might fit suitably within such storage space will include cereal, thin fruit slices, small crackers, etc.

Figure 13:
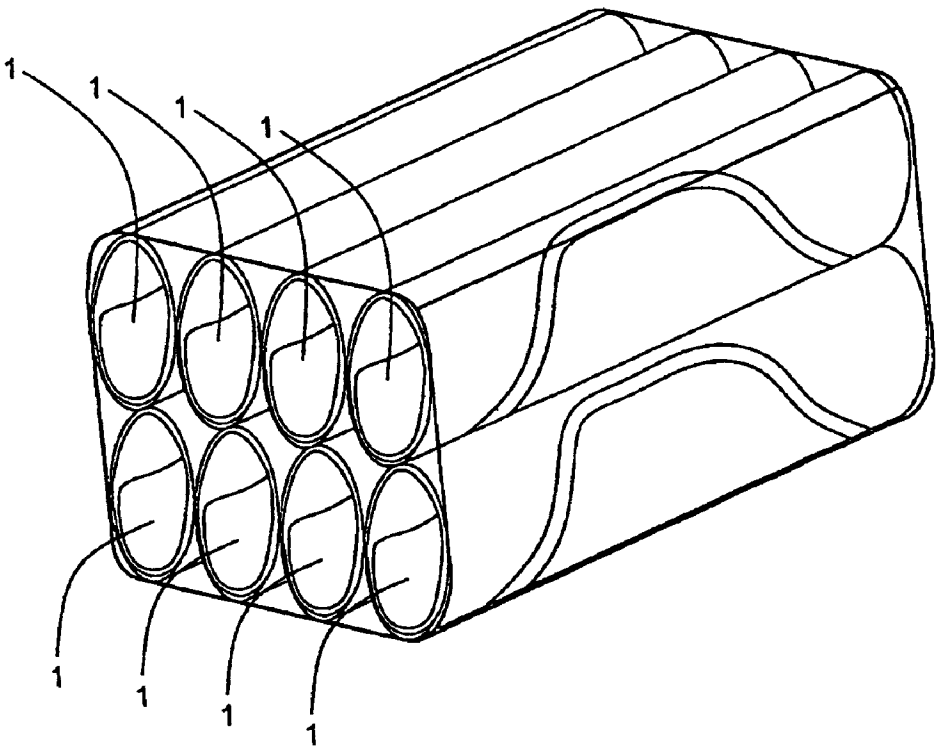
FIG. 13 is a perspective view of eight reconfigurable mealtime totes of the present invention (including drinking cup and utensils) made from disposable/recyclable materials and shown compactly packaged together in an optically clear plastic wrap, similar to the way paper towels are packaged and distributed in modern times.

In a fifth illustrative embodiment shown in FIG. 13, eight presanitized, reconfigurable mealtime accessory totes (including drinking cup and mealtime utensils, and towelettes) 1, 1' or 1" made from disposable/recyclable materials are shown compactly packaged together in an optically clear plastic wrap, similar to the way paper towels are packaged and distributed in modern times. Caregivers could purchase such packaged quantities of mealtime accessory totes of the present invention, store them in the their homes, or in back of their automobiles or wagons, and access them as needed for use at restaurants, parks and the like.

In a fifth illustrative embodiment shown in FIG. 14, eight presanitized, reconfigurable mealtime accessory totes (including drinking cup and mealtime utensils, and towelettes) 1, 1' or 1" made from disposable/recyclable materials are shown compactly packaged together in an optically clear plastic wrap, similar to the way paper towels are packaged and distributed in modern times. Caregivers could purchase such packaged quantities of mealtime accessory totes of the present invention, store them in the their homes, or in back of their automobiles or wagons, and access them as needed for use at restaurants, parks and the like.

Having the benefit of the present disclosure, variations and modifications to the illustrative embodiments will readily come to mind.

For example, the mealtime accessory tote of the present invention can be sold or provided without a drinking cup and/or mealtime utensils, but nevertheless, without departing from the scope or spirit of the present invention.

One or both sides of the bib-shaped structure 2 can carry graphical art forms representative of trademarks, servicemarks, logos, characters or other forms of graphical intelligence aimed at building brand-value in the minds of child caregivers who would use the mealtime accessory tote of the present invention.

The mealtime accessory tote of the present invention can be provided to customers and patrons of restaurants, fast food eateries, theme parks, etc. In such applications of the present invention, the drinking cup mealtime accessory might bear the brand logo and symbols of the tote provider, and functioning as a valuable form of brand marketing communication.

The mealtime accessory tote of the present invention should be of great value to caregivers who choose to take-out food, and eat away from restaurants.

These and all other such modifications and variations are deemed to be within the scope and spirit of the present invention as defined by the accompanying Claims to Invention.

What is claimed is:

1. A reconfigurable mealtime accessory tote that has both a transport configuration and a mealtime configuration, and which comprises:

a bib-shaped structure of pliant and light-weight construction, having a front surface, a rear surface, a first pocket formed on said front surface and having a side opening adapted to receive and support a set of mealtime utensils along a horizontal direction, and a second pocket that has a top opening that extends substantially across the width of said bib-shaped structure and which can receive and store a baby bottle or drinking cup, arranged along said horizontal direction during said transport configuration, and can catch and store food particles during said mealtime configuration;

wherein when said reconfigurable mealtime accessory tote is arranged in said transport configuration, said bib-shaped structure is adapted to wrap around said baby bottle or drinking cup, and said mealtime utensils, arranged along said horizontal direction, and form a rolled up three-dimensional volumetric structure that can be releasably fastened together by a fastening mechanism, so to provide as a single, compact tote assembly that can be transported to a location remote from home; and wherein when said reconfigurable mealtime accessory tote is arranged in said mealtime configuration, said bib-shaped structure is supported upon the chest and about the neck of a child wearer, and protecting his or her clothing from soiling while the child wearer is eating his or her meal using said drinking cup or baby bottle, and mealtime utensils that were contained within said reconfigurable mealtime accessory tote during said transport configuration.

2. The reconfigurable mealtime accessory tote of claim 1, wherein said bib-shaped structure further comprises a strap provided as a handle that allows the reconfigurable tote to be carried by hand to locations remote from home, and which also is capable of holding a pacifier, teether or other toy securely in place once said reconfigurable mealtime accessory tote has been reconfigured into said mealtime configuration and put to use on the child wearer by a caregiver.

3. The reconfigurable mealtime accessory tote of claim 1, which further includes a third pocket formed on said front surface and having a top opening adapted to receive meal time equipment selected from the group consisting of disposable wipes, a box of crayons, and small toys or articles of amusement and/or entertainment.

4. The reconfigurable mealtime accessory tote of claim 3, wherein said bib-shaped structure is constructed from a dishwasher-safe material so that the bib-shaped structure, the drinking cup or baby bottle and meal utensils can all be placed together in a dishwasher to be cleaned and sanitized prior to the next use.

5. The reconfigurable mealtime accessory tote of claim 1, wherein said rolled up three-dimensional volumetric structure is a substantially cylindrical geometry.

6. The reconfigurable mealtime accessory tote of claim 1, wherein said rolled up three-dimensional volumetric structure is a substantially rectangular geometry.

7. The reconfigurable mealtime accessory tote of claim 1, wherein said set of mealtime utensils comprises a spoon and fork.

* * * * *